US008235346B2

(12) United States Patent
Bakos

(10) Patent No.: US 8,235,346 B2
(45) Date of Patent: Aug. 7, 2012

(54) SUPPORT BRACKET FOR A COLUMN

(76) Inventor: Stephen M. Bakos, Jim Thorpe, PA (US)

( * ) Notice: Subject to any disclaimer, the term of this patent is extended or adjusted under 35 U.S.C. 154(b) by 225 days.

(21) Appl. No.: 12/642,782

(22) Filed: Dec. 19, 2009

(65) Prior Publication Data

US 2010/0098499 A1 Apr. 22, 2010

Related U.S. Application Data

(62) Division of application No. 12/116,276, filed on May 7, 2008, now Pat. No. 7,677,522.

(51) Int. Cl.
*A47B 97/00* (2006.01)

(52) U.S. Cl. ..... 248/500; 248/354.1; 248/357

(58) Field of Classification Search ..... 248/151, 248/523, 519, 524; 52/296, 298, 693, 297, 52/741.2, 182, 832
See application file for complete search history.

(56) References Cited

U.S. PATENT DOCUMENTS

| | | | | |
|---|---|---|---|---|
| 2,182,579 | A | 12/1939 | Bolton et al. | |
| 2,280,220 | A * | 4/1942 | Crosby | 52/126.6 |
| 4,295,308 | A * | 10/1981 | Korfanta | 52/296 |
| 4,367,864 | A * | 1/1983 | Eldeen | 256/59 |
| 4,387,543 | A | 6/1983 | Tschan et al. | |
| 4,924,648 | A | 5/1990 | Gilb et al. | |
| 5,379,563 | A | 1/1995 | Tinsley | |
| 5,419,538 | A * | 5/1995 | Nicholas et al. | 256/65.14 |
| 5,467,569 | A | 11/1995 | Chiodi et al. | |
| 7,621,097 | B2 * | 11/2009 | Wilhour | 52/741.15 |
| 7,918,059 | B2 * | 4/2011 | Repasky | 52/263 |
| 2002/0078638 | A1 * | 6/2002 | Huang | 52/126.6 |
| 2004/0074170 | A1 * | 4/2004 | Huang | 52/220.1 |
| 2007/0107339 | A1 | 5/2007 | Matsumoto | |
| 2007/0187568 | A1 | 8/2007 | Titus et al. | |

* cited by examiner

*Primary Examiner* — Amy J. Sterling
(74) *Attorney, Agent, or Firm* — Harold L. Masteller

(57) ABSTRACT

A, support bracket and column for supporting an elevated structure during and after construction. The support bracket includes a connection plate that is attached to and overlapped by the column base so that the support bracket is concealed from view when construction is completed, and variations of the support bracket provide means to raise or lower the attached column during construction.

21 Claims, 6 Drawing Sheets

Fig. 5
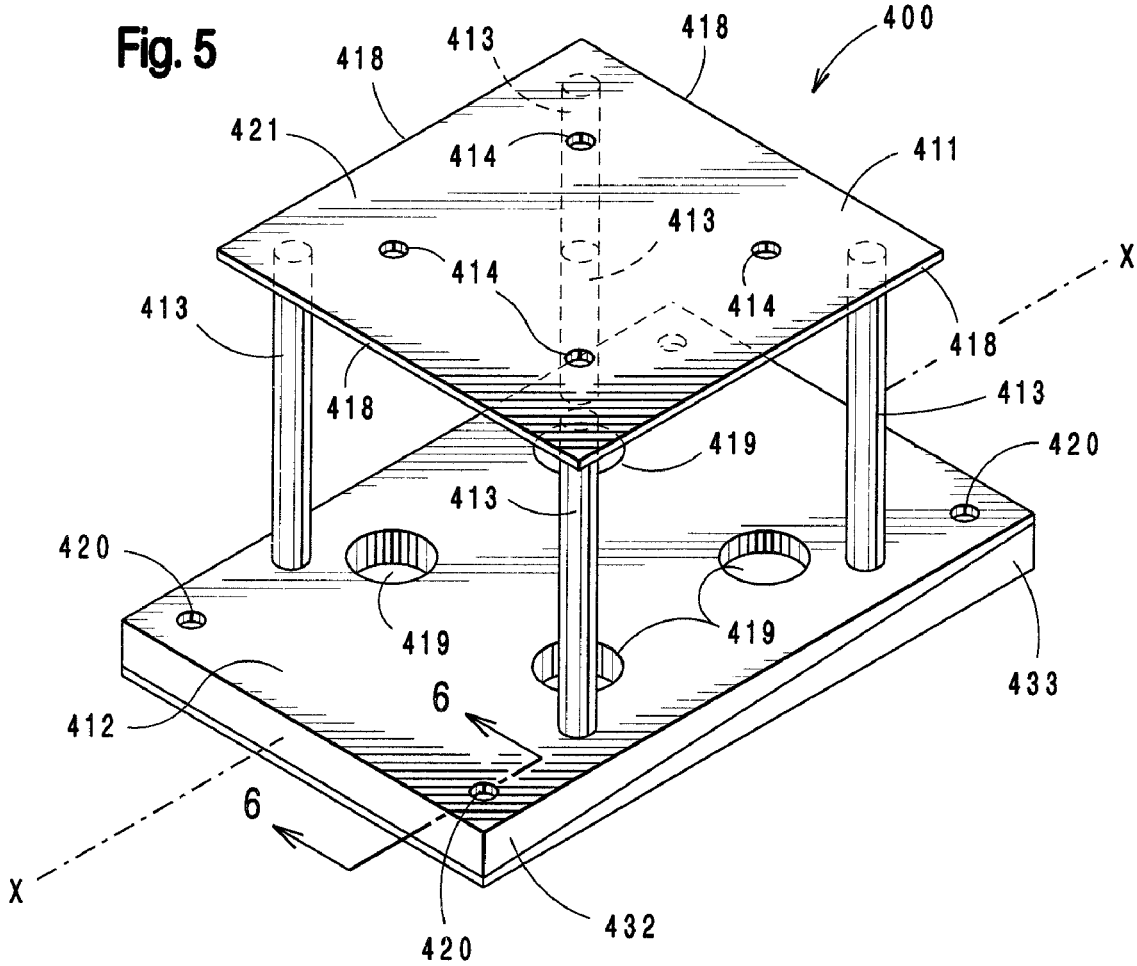
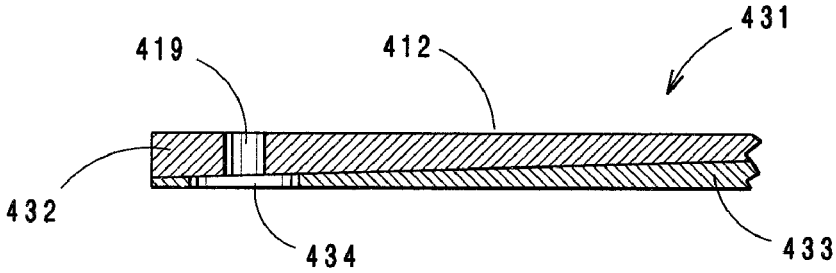
Fig. 6

SUPPORT BRACKET FOR A COLUMN

This is a division of application Ser. No. 12/116,276, filed May 7, 2008, now U.S. Pat. No. 7,677,522.

BACKGROUND

The present invention is directed to a column support bracket that fixes a permanent column at a predetermined position during the construction phase of an elevated structure, an integrated column and support bracket where the bracket is concealed from view after construction of the elevated structure is completed.

Architectural designs frequently include elevated structures, for example cantilevered decks, balconies, rooms, or the like that extend outward from the main building and require temporary support members during the construction phase. A footing or foundation wall is poured by concrete workers followed by carpenters who erect temporary bracing or framework to support the elevated structure during construction. When the structure is completed, the concrete workers and/or masons return to complete the foundation work which may include pouring a concrete slab, laying up masonry work or both. After the finish work is completed for the foundation, carpenters return to disassemble the temporary framework and erect permanent columns that support the elevated structure on the finished foundation. Such repetitive use of the labor force, and the erection of temporary framework, is inefficient in time, energy, and/or materials, and increases construction costs.

BRIEF SUMMARY OF THE INVENTION

The present invention overcomes inefficient construction practices by providing an integrated column and support bracket for use during the construction phase and for use as a permanent or finished column that conceals the support bracket from view when construction work is completed. In the preferred embodiment, the support bracket includes a top connection plate that is fixed to and is overlapped by the underside surface or base of the column, a bottom foundation plate that is fixed to a foundation, for example but not limited to a footer, wall, slab or the like, and at least one strut that extends between the top and bottom plates of the support bracket.

In one variation of the preferred embodiment, the top connection plate includes an upward extending tube member that is fixed within the hollow interior of a tubular column.

In another variation, the strut, or the plurality of struts are adjustable along the vertical axis so that the distance between the top connection plate and bottom foundation plate can be increased or decreased to position the connection plate or column base at a desired elevation.

In another variation, the support bracket foundation plate includes a sliding wedge mechanism that provides vertical adjustment to position the top connection plate or column base at a desired elevation.

As used herein, the term "column" refers to any vertical structural member capable of supporting elevated structures, including a simple square, rectangular, or round post manufactured from wood or other suitable material, a complex classical pillar such as Ionic, Doric or like column, or other suitable architectural shapes and designs including tubular columns.

The term "foundation" refers to any support structure capable of supporting calculated live and/or dead loads for a particular structure including but not limited to footers, foundations, walls, slabs, pillars, and pilings.

The term "strut" as used herein refers to a structural member or stiffener that extends between the top connection plate and the bottom foundation plate of the present support bracket invention to resist compression and shear forces.

The term "hidden bracket" or "concealed bracket" refers to a column support bracket that is not visible or is hidden from view when the construction work is completed.

Accordingly, it is a first object of the present invention to provide a support bracket and/or an integrated column and support bracket for use during the construction phase of an elevated structure.

It is another object of the present invention to provide a support bracket or integrated column and support bracket that is concealed from view when construction work is completed.

It is a further object of the present invention to provide a support bracket that reduces construction cost.

It is still another object of the present invention to provide a support bracket that is adjustable in the vertical direction after installation at a construction site.

It is another object of the present invention to provide an integrated column and support bracket that provides vertical adjustment to position the column base at a desired elevation after installation at a construction site.

Specifically, this invention comprises a bracket that supports a column during construction and after construction of an elevated structure. The bracket includes a top connection plate fixed to and overlapped by the bottom surface or base of the supported column, a bottom foundation plate fixed to a structure, and at least one strut that extends between the connection plate and foundation plate. The overlapped connection plate conceals the bracket from view when construction is completed.

Another aspect of the present invention includes a column support bracket with an adjustable strut or a plurality of adjustable struts that are operated to position the connection plate or column base at a desired elevation after installation at a construction site.

Still another aspect of the present invention includes a column support bracket with a sliding wedge mechanism in the base plate that is operated to position the connection plate or column base at a desired elevation after installation at a construction site.

BRIEF DESCRIPTION OF THE DRAWINGS

FIG. 5 is an isometric view showing a support bracket with a foundation plate that includes a sliding wedge mechanism.

FIG. 6 is a cross-section along the lines 6-6 in FIG. 5.

DETAILED DESCRIPTION OF THE INVENTION

Figure 1:
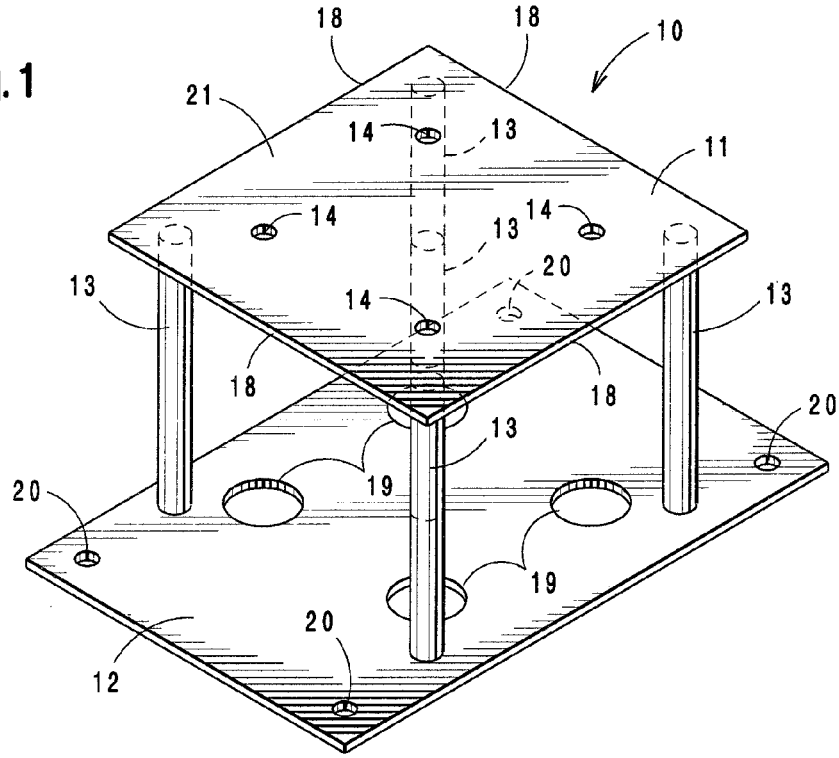
FIG. 1 is an isometric view of the preferred embodiment of the present support bracket invention.
Figure 2:
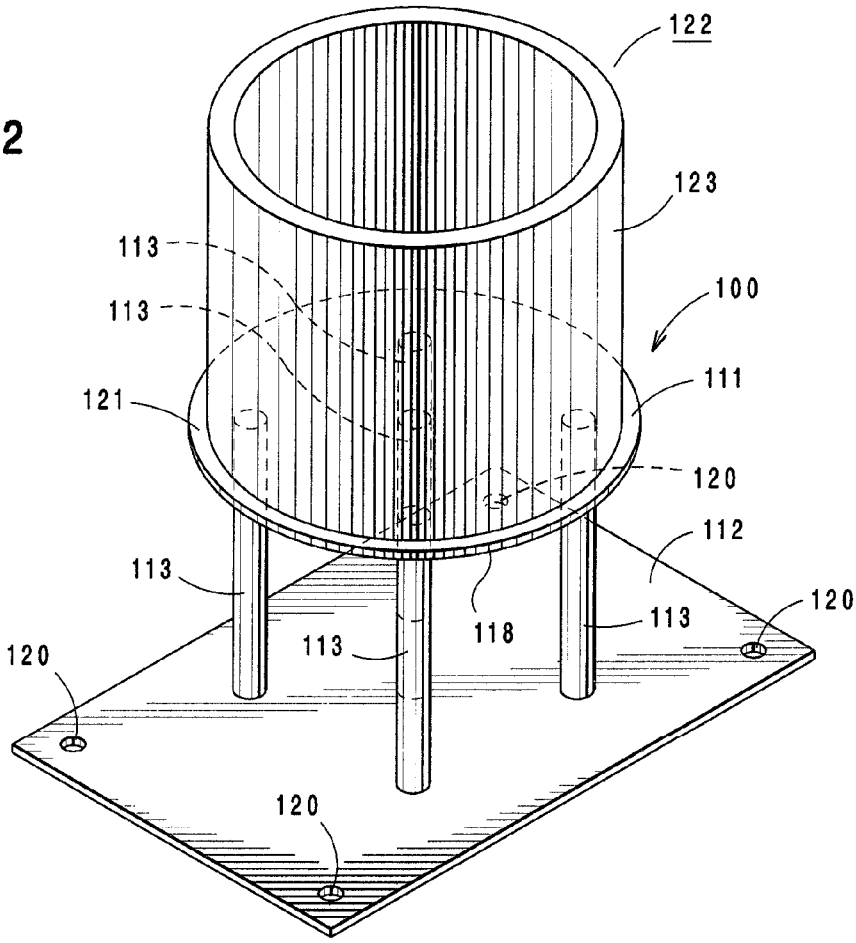
FIG. 2 is an alternate embodiment of the support bracket in FIG. 1 adapted for use with a round column.

Referring to the drawings, FIG. 1 shows one embodiment of the present invention comprising a support bracket 10 that includes a top connection plate 11, a bottom foundation plate 12 and one or more struts 13 fixed to and extending between the connection plate and foundation plate. Connection plate 11 includes an arrangement of apertures 14 that accommodate fasteners 215 for fixing the connection plate to the underside surface or base 216 of column 217 (FIGS. 7-10). A set of apertures 19 in the foundation plate are aligned with apertures 14 in the connection plate to provide tool access for driving fasteners 215 into the base of column 17. Foundation plate 12 includes a second set of apertures 20 for attaching the foundation plate to a foundation using fasteners suited for the particular foundation installed at the jobsite.

The surface area 21 of the connection plate is less than the base surface area of column 217 so that the column overlaps the connection plate periphery 18 when the plate is fixed to the underside of the column. The attached, overlapped support bracket 10 provides an integrated column and support bracket. As explained in greater detail below (FIGS. 7-10), the integrated column supports an elevated structure during and after construction, and because the support bracket is only fixed to the underside surface of the column base, it is concealed from view when the foundation finish work is completed at the jobsite.

Figure 12:
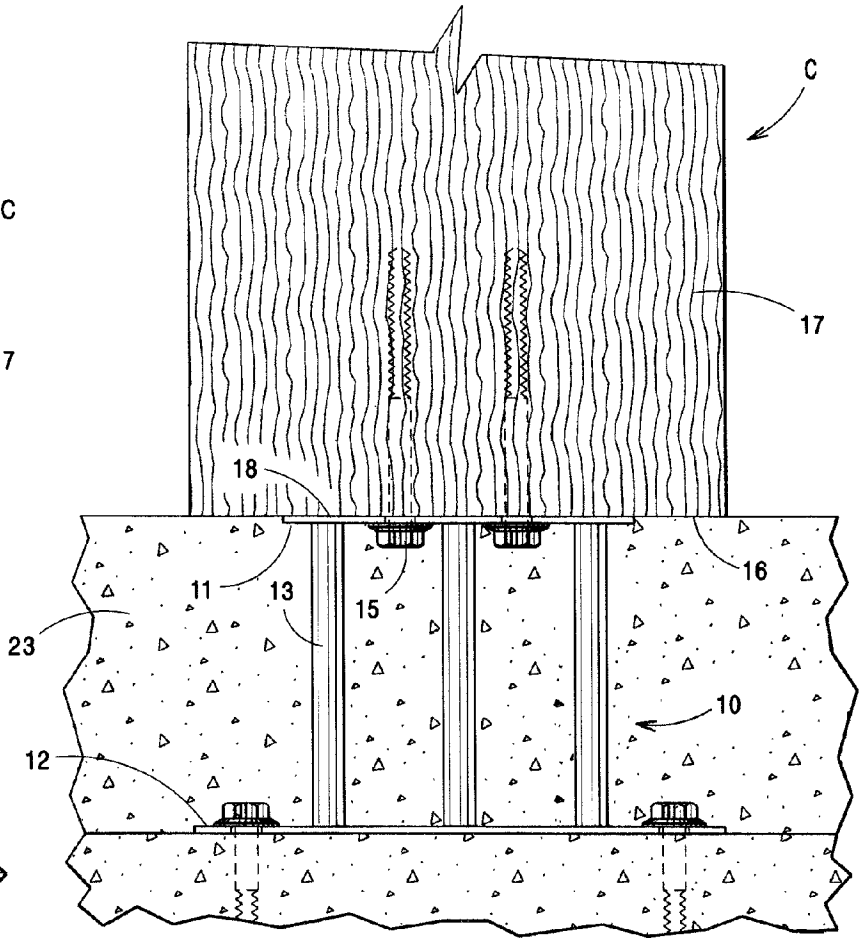
FIG. 12 shows the support bracket in FIG. 11 concealed from view after construction is completed.
Figure 11:
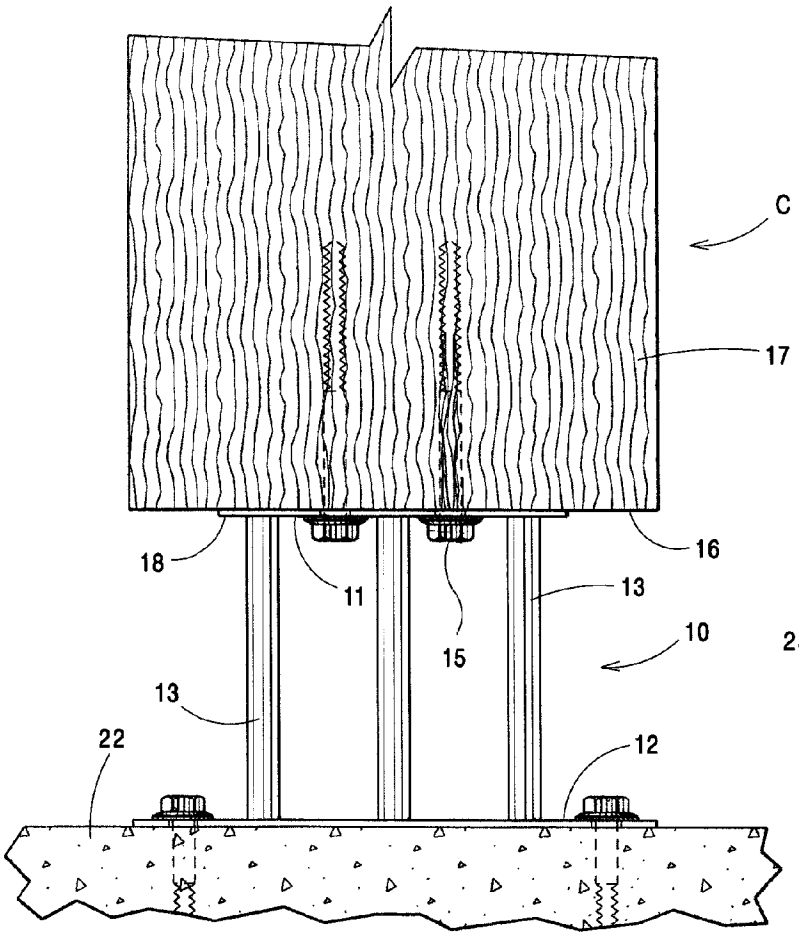
FIG. 11 is an elevation view of the support bracket in FIG. 1 positioned on a foundation.

Referring to FIGS. 1, 11, and 12 one embodiment of the present invention comprises a support bracket 10 that includes a top connection plate 11, a bottom foundation plate 12 and one or more struts 13 fixed to and extending between the connection plate and foundation plate. Connection plate 11 includes an arrangement of apertures 14 that accommodate fasteners 15 for fixing the connection plate to the underside surface or terminal bottom end 16 of column 17. A set of apertures 19 in the foundation plate are aligned with apertures 14 in the connection plate to provide tool access for driving fasteners 15 into the base of column 17. Foundation plate 12 includes a second set of apertures 20 for attaching the foundation plate to a foundation 22 using fasteners suited for the particular foundation installed at the jobsite.

The top surface 18 of the connection plate is fixed to and abuts the terminal bottom end 16 of column 17 so that the column overlaps the connection plate periphery when the plate is fixed to the underside of the column. The attached, overlapped support bracket 10 provides an integrated column and support bracket "C" that supports an elevated structure during and after construction. As shown in FIG. 12, support bracket 11 is positioned so that its top surface is aligned or is flush with a predetermined top or surface elevation of the material 23 used to complete foundation 22. This flush surface alignment enables portions of the support bracket that extend below top surface 18 to be embedded and concealed within the completed foundation material 23 while the abutting top surface 18, aligned flush with the top surface of the completed foundation material 23, and the fasteners that fix the connection plate to the column, are concealed under the terminal bottom end 16 of the column.

The surface area 121 of connection plate 111 is less than the underside surface area of the tubular column so that the column overlaps the connection plate periphery 118 when tubular member 122 is fixed within the column. The overlapped connection plate provides an integrated column and support bracket that can be used as a permanent support during and after the construction of an elevated structure, and the overlapping tubular column conceals the integrated support bracket from view when construction is completed at the jobsite, similar to the final step shown in FIG. 10.

Figure 3:
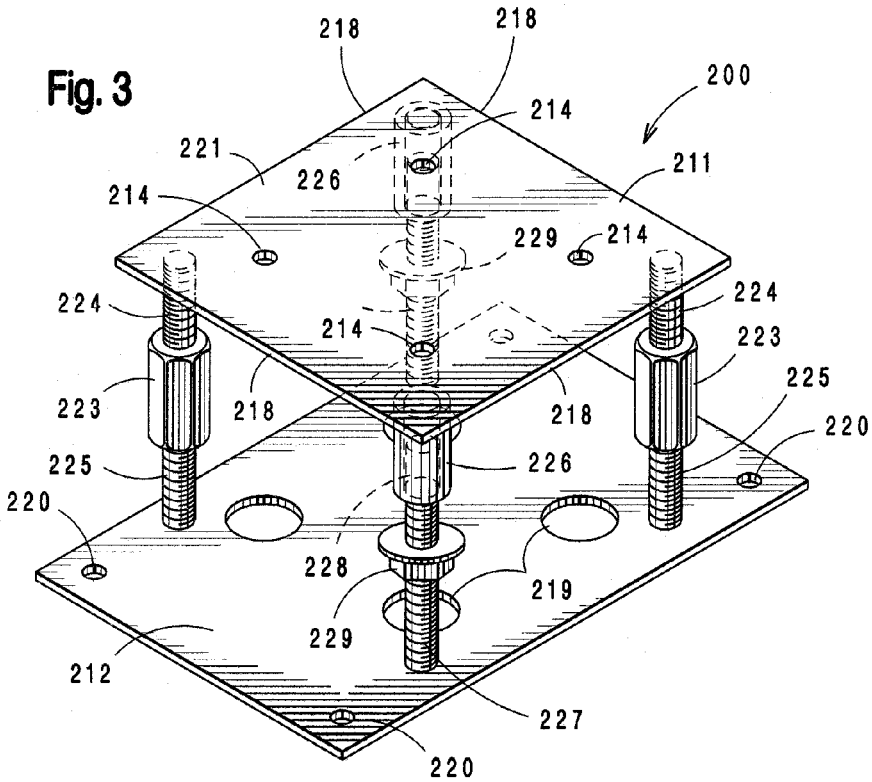
FIG. 3 is an isometric view of the support bracket showing a plurality of adjustable struts.

FIG. 3 shows another variation of the present support bracket invention 200 comprising a top connection plate 211 with apertures 214 for attaching the plate to the underside surface or base 216 of a column, and a bottom foundation plate 212 with apertures 219 that provide tool access for attaching the connection plate to the column base, and apertures 220 for fasteners that attach plate 212 to a foundation.

The struts 213 that extend between the connection plate and the foundation plate are adjustable so that the distance between plates 211 and 212 can be increased or decreased. This provides means to either raise or lower the elevation of connection plate 211 after plate 212 is fixed to a foundation. At least one of the struts 213 comprises an adjustment mechanism similar to a turnbuckle where the mechanism includes a head 223 threaded to receive a left hand thread stub end 224 and a right hand thread stub end 225. The remaining struts, herein after referred to as retainer struts, prevent accidental movement of the connection plate 211 after the plate is adjusted to a desired elevation. Each retainer strut includes a collar 226 that extends downward from and is fixed to the bottom surface of connection plate 211, a threaded rod having a first end 227 fixed to the foundation plate 212 and a second end 228 enclosed, with a running or sliding fit, within collar 226, and a locknut 229 that is seated against the bottom surface of collar 226 to restrict connection plate movement in its adjusted position and provide additional resistance to compression and shear when supporting a column.

Similar to the above the descriptions, the surface area 221 of connection plate 211 is less than the underside surface area of the supported column so that the column overlaps the connection plate periphery 218 when the connection plate is fixed within the bottom or underside surface of the column. The overlapped connection plate provides an integrated column and support bracket that can be adjusted to position the connection plate 211 or column base at a desired elevation after the foundation plate is fixed to a structure during construction, and the overlapping column conceals the integrated support bracket from view when construction work is completed at the jobsite.

Figure 4:
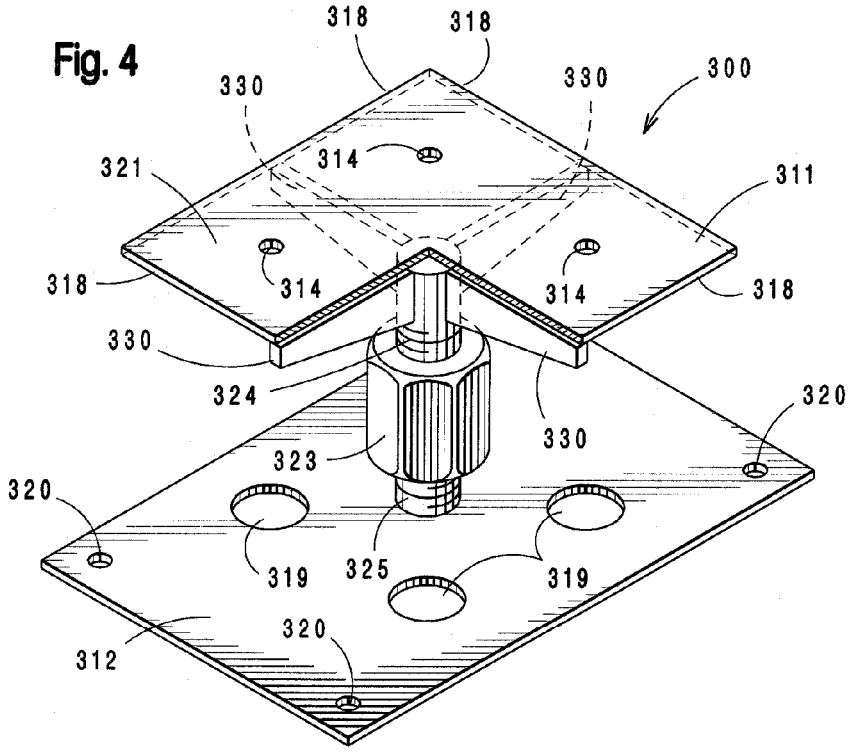
FIG. 4 is an isometric view showing the support bracket with a single adjustable strut.

FIG. 4 shows another embodiment of the present support bracket invention 300 comprising a top connection plate 311 with apertures 314 for attaching the connection plate to the underside surface or base of a column, and a bottom foundation plate 312 with apertures 319 that provide tool access for driving fasteners through the connection plate apertures 214 and into the column base, and apertures 220 for fasteners that attach plate 212 to a foundation. A single adjustable strut 313 extends between the connection plate and the foundation plate to increase or decrease the distance between plates 211 and 212 and position connection plate 211 or column base at a desired elevation after the foundation plate 212 is fixed to a structure. Strut 313 comprises an adjustment mechanism similar to a turnbuckle that includes a head 323 threaded to receive a left hand thread stub end 324 and a right hand thread stub end 325. Stiffener plates 330 are attached to the stub end 324 and connection plate 311 to provide stabilization and resistance compression and shear forces generated by construction activity.

As before, the surface area 321 of connection plate 311 is less than the underside surface or base area of the supported column so that the column completely overlaps the connection plate periphery 318 when the connection plate is fixed to the base of the column. The overlapped connection plate provides an integrated column and support bracket that can be adjusted to position the connection plate or column base at a desired elevation when the foundation plate is fixed to a structure and while the column is used as a support for an elevated structure during construction. The overlapping column conceals its integrated support bracket from view when construction work is completed at the jobsite.

FIGS. 5 and 6 show an adjustable support bracket invention 400 with a sliding wedge mechanism 431 for raising or lowering the connection plate 411 or column base to a desired elevation. Connection plate 411 includes apertures 414 for attaching the connection plate to the underside surface or base of a column as described in the above embodiments, and a bottom foundation plate assembly 412 includes a sliding wedge mechanism 431. The sliding wedge includes at least two wedge shaped plates 432 and 433 that are positioned to slide against each other in two directions along the length or x-axis of the foundation plate assembly 412. The first or top wedge plate 432 includes apertures 419 to receive fasteners that fix the plate assembly to a foundation. Apertures 419 are aligned with corresponding elongated apertures 434 that extend through the last or bottom wedge plate 433. When used as an integrated support bracket for a column, fasteners are driven through apertures 419 and 434 and into a foundation, but the fasteners are not driven home. The loosely driven fasteners hold the first wedge plate 432 in a fixed position on the foundation while the elongated apertures 434 enable the last or bottom wedge plate 433 to slide along the x-axis to raise or lower the connection plate 411 or column base to a desired elevation. The fasteners are driven home to fix the entire foundation plate assembly 412 to the foundation after elevation is properly adjusted.

One or more struts 413 extend between the connection plate and the foundation plate assembly to resist compression and shear forces encountered during construction. As heretofore described above, the surface area 421 of connection plate 411 is less than the underside surface or base area of the supported column so that the column completely overlaps the connection plate periphery 418 when the connection plate is fixed within the column base. The overlapped connection plate provides an integrated column and support bracket that can be adjusted to position connection plate 411 at a desired elevation while the column is used as a support for an elevated structure during construction, and the overlapping column conceals its integrated support bracket from view when construction work is completed at the jobsite.

FIGS. 7-10 show the present integrated column and support bracket invention in use during construction of an elevated structure and after construction is completed. It should be understood, however, that although FIGS. 7-10 show the adjustable support bracket 200 in FIG. 3, any one of the preceding bracket embodiments may be used in a manner similar to the following description.

Figure 7:
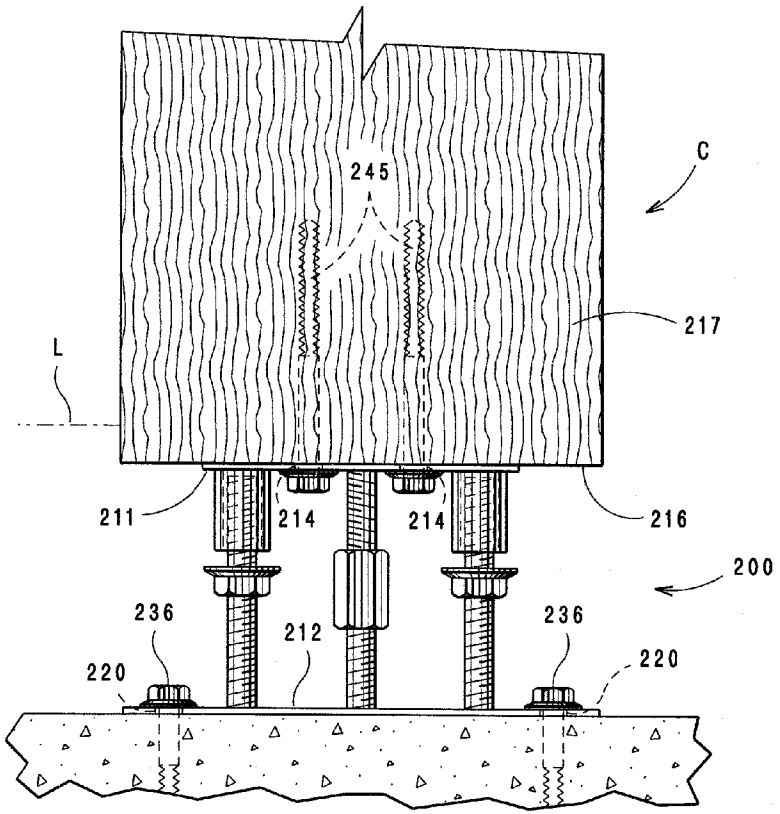
FIG. 7 is an elevation view of the support bracket in FIG. 3 positioned on a foundation.

Referring to FIG. 7, the top connection plate 211 of support bracket 200 is fixed to the underside surface or base 216 of column 217 with fasteners 245 driven through apertures 214 and into the column to provide an integrated column and support bracket "C." The foundation plate 212 is placed at a location along a foundation and fasteners 236 are driven through apertures 220 in the foundation plate to fix the plate to the foundation structure 237. An elevation or level line "L" is established for the underside surface or base 216 of the integrated column "C."

Figure 8:
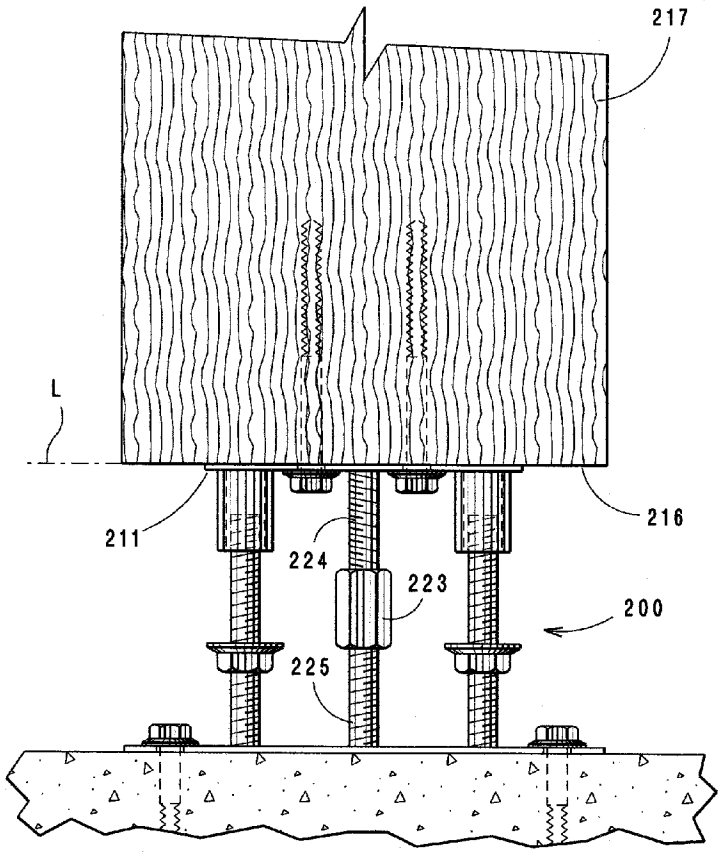
FIG. 8 shows the support bracket in FIG. 7 adjusted to a desired elevation.
Figure 9:
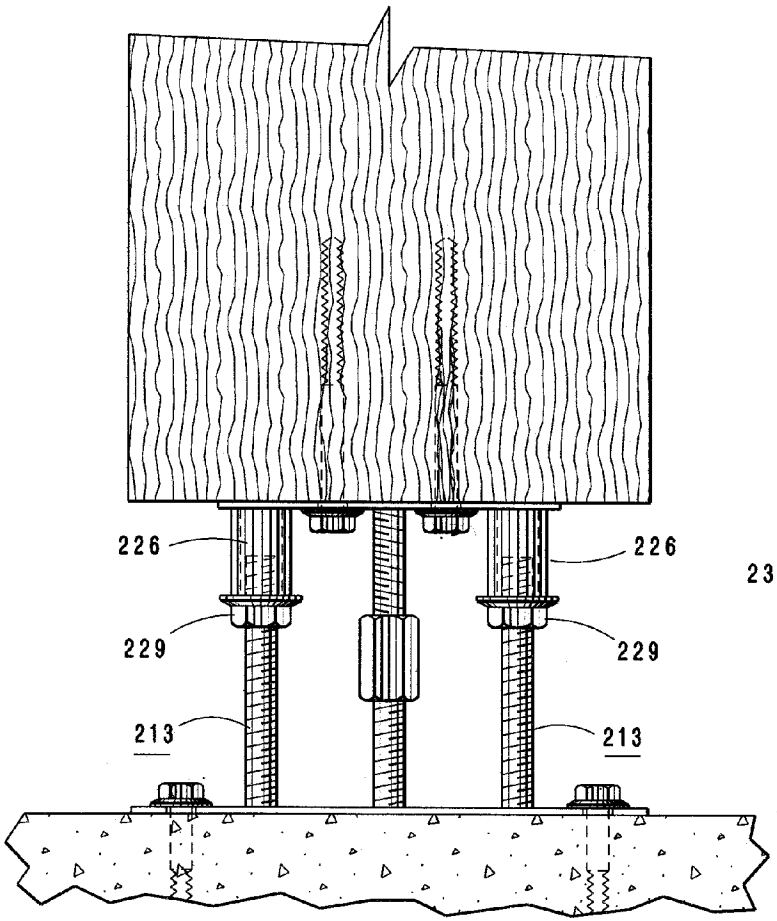
FIG. 9 shows the support bracket in FIG. 8 locked to restrict connection plate movement.

Referring to FIG. 8, head 223 of the turnbuckle strut is rotated to extend or retract the threaded stub ends 224 and 225 so that the column base 216 is adjusted to the desired elevation "L." In this instance, head 223 is rotated to extend the stub ends and raise the top surface of connection plate 211 along with the column base to elevation "L." After the column base is adjusted to elevation, the locknuts 229 in the remaining struts 213 are rotated to bear against the bottom surface of collars 226 as shown in FIG. 9. The locknuts fix the position of connection plate 211 and prevent accidental movement out of elevation during construction, and the retainer struts increase resistance to compression and shear forces generated during the construction of the supported elevated structure (not shown). As mentioned in the description for FIG. 3, support bracket 200 may include more than one turnbuckle like strut.

Figure 10:
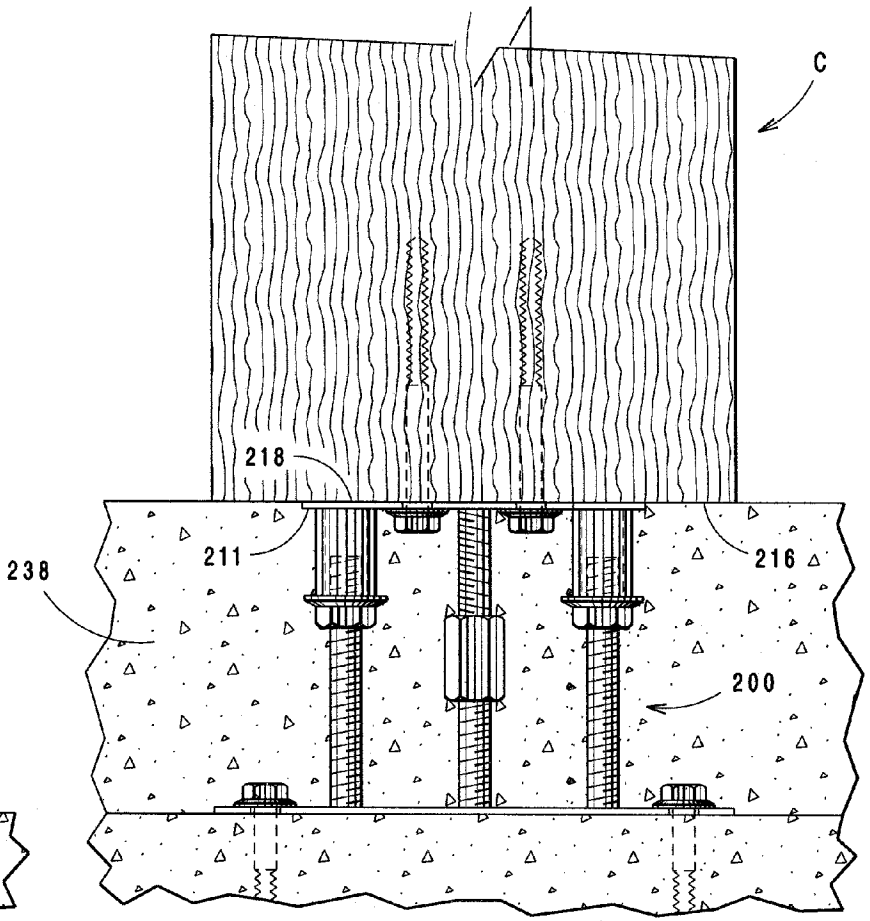
FIG. 10 shows the support bracket in FIG. 9 concealed from view after construction is completed.

Referring to FIG. 10, after construction of the elevated structure is completed, concrete workers and/or masons return to the jobsite to complete the supporting foundation by providing a finished foundation 238 which may include, but is not limited to, a concrete slab, masonry work or both. The various components of support bracket 200 that extend below the top surface area 218 of the connection plate 211 are embedded in the finished foundation structure 238. The top surface 218 of the connection plate is overlapped by the underside surface or base 216 of the column and therefore, the entire support bracket 200 is concealed from view when the finish work for the elevated structure is completed. Because the integrated column "C" is used during and after construction of the elevated structure, it is not necessary to recall carpenters to the job site to remove temporary bracing and install permanent support columns. Such streamlined construction operations save both time and cost.

As such, an invention has been disclosed in terms of preferred embodiments and alternate embodiments thereof, which fulfills each one of the objects of the present invention as set forth above and provides an integrated column and support bracket for use during and after construction of an elevated structure where the entire support bracket is concealed from view when construction of the elevated structure is completed. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A support bracket used during and after construction to maintain a column at a fixed position between a foundation and an elevated architectural structure that extends outward from the exterior of a main building, comprising:

a) a foundation plate fixed to an unfinished foundation;

b) a connection plate spaced apart from said foundation plate, said connection plate having a top surface abutting the terminal bottom end of the column and fixed thereto with at least one fastener, the terminal bottom end overlapping the periphery of said connection plate and said at least one fastener; and c) at least one strut extending between and fixed to a top surface of said foundation plate and fixed to a bottom surface of said connection plate so that said abutting top surface of said connection plate is positioned in a flush alignment with a predetermined top surface elevation of material used to complete the unfinished foundation;

whereby, after construction, said support bracket portions that extend downward from the abutting top surface of said connection plate are embedded and concealed within the material used to complete the foundation, said abutting top surface of the connection plate is aligned flush with the top surface elevation of the completed foundation, and the abutting top surface and said at least one fastener are concealed by the overlapping terminal bottom end of the column.

2. The support bracket recited in claim 1, wherein: said connection plate and said foundation plate spaced apart distance is fixed.

3. The support bracket recited in claim 2, comprising: connection apertures that extend through said connection plate so that said support bracket can be attached to the underside surface of said column base with fasteners driven through said connection apertures and into said terminal bottom end.

4. The support bracket recited in claim 2, comprising: foundation apertures that extend through said foundation plate so that said support bracket can be attached to a foundation with fasteners driven through said foundation apertures and into the foundation.

5. The support bracket recited in claim 3, comprising: tool apertures that extend through said foundation plate, said tool apertures aligned with said connection apertures to provide access for a tool that drives fasteners through said connection apertures and into said base.

6. The support bracket recited in claim 1, said at least one strut, comprising: a mechanism to increase or decrease the length of said at least one strut, said mechanism operated to adjust said spaced apart distance between the connection plate and the foundation plate.

7. The support bracket recited in claim 6, said mechanism to increase or decrease the said at least one strut length, comprising: a head threaded onto a first stub end fixed to said top surface of the foundation plate and threaded onto a second stub end fixed to said underside surface of the connection plate, said head rotated to increase or decrease the length of said at least one strut.

8. The support bracket recited in claim 7, comprising: at least one retainer strut to selectively fix said connection plate and said foundation plate at a desired spaced apart distance.

9. The support bracket recited in claim 8, said at least one retainer strut comprising: a threaded rod having a first end fixed to said top surface of the foundation plate and a second end slideably engaged within a collar fixed to and extending downward from said bottom surface of the connection plate, and a threaded locknut that selectively engages said collar to fix said connection plate and said foundation plate at said desired spaced apart distance.

10. The support bracket recited in claim 1 wherein said foundation plate is vertically adjustable, said foundation plate, comprising: a sliding wedge mechanism to provide said vertical adjustment.

11. The support bracket recited in claim 10, said sliding wedge mechanism, comprising:

a) a first wedge plate with apertures shaped to receive fasteners that fix said foundation plate to a foundation; and b) a last wedge plate positioned between said first wedge plate and the foundation, said last wedge plate including elongated apertures that correspond with said apertures shaped to receive fasteners so that said last wedge plate is able to slide longitudinally and vertically adjust the foundation plate.

12. An integrated column and support bracket used during and after construction to maintain the column at a fixed position between a foundation and an elevated architectural structure that extends outward from the exterior of a main building, comprising:

a) a column comprising a first end for attachment to the elevated structure, and a terminal bottom end opposite said first end; and b) a support bracket, comprising;

i) a foundation plate fixed to an unfinished foundation;

ii) a connection plate spaced apart from said foundation plate, said connection plate having a top surface abutting said terminal bottom end of said column and fixed thereto with at least one fastener, said terminal bottom end overlapping the periphery of said connection plate and said at least one fastener; and iii) at least one strut extending between and fixed to a top surface of said foundation plate and fixed to a bottom surface of said connection plate so that said abutting top surface of said connection plate is positioned in a flush alignment with a predetermined top surface elevation of material used to complete the unfinished foundation;

whereby, after construction, said support bracket portions of the integrated column and support bracket that extend downward from said abutting top surface are embedded and concealed within the material used to complete the foundation, the abutting top surface of said connection plate is aligned flush with the top surface elevation of the completed foundation, and the abutting top surface and said at least one fastener are concealed by the overlapping terminal bottom end of the column.

13. The integrated column and support bracket recited in claim 12, wherein: said connection plate and said foundation plate spaced apart distance is fixed.

14. The integrated column and support bracket recited in claim 12, comprising: foundation apertures that extend through said foundation plate so that said support bracket can be fixed to a foundation with fasteners driven through said foundation apertures.

15. The integrated column and support bracket recited in claim 12, comprising: tool apertures that extend through said foundation plate, said tool apertures aligned with connection apertures that extend through said connection plate to provide access for a tool that drives fasteners through said connection apertures and into said terminal bottom end.

16. The integrated column and support bracket recited in claim 12, said at least one strut, comprising: a mechanism to increase or decrease the length of said at least one strut, said mechanism operated to adjust the spaced apart distance between said connection plate and said foundation plate.

17. The integrated column and support bracket recited in claim 16, the mechanism to increase or decrease said at least one strut length, comprising: a first stub end fixed to said top surface of the foundation plate and threaded onto a second stub end fixed to said underside surface of the connection plate, said head rotated to increase or decrease the length of said at least one strut.

18. The integrated column and support bracket recited in claim 17, comprising: at least one retainer strut to selectively fix said connection plate and said foundation plate at a desired spaced apart distance.

19. The integrated column and support bracket recited in claim 18, said at least one retainer strut comprising: a threaded rod having a first end fixed to said top surface of the foundation plate, a second end slideably engaged within a collar fixed to and extending downward from said bottom surface of the connection plate, and a threaded locknut that selectively engages said collar to fix said connection plate and said foundation plate at said desired spaced apart distance.

20. The integrated column and support bracket recited in claim 12 wherein said foundation plate is vertically adjustable, said foundation plate, comprising: a sliding wedge mechanism to provide said vertical adjustment.

21. The integrated column and support bracket recited in claim 20, said sliding wedge mechanism, comprising:

a) a first wedge plate with apertures shaped to receive fasteners that fix said foundation plate to a foundation; and b) a last wedge plate positioned between said first wedge plate and the foundation, said last wedge plate including elongated apertures that correspond with said apertures shaped to receive fasteners so that said last wedge plate is able to slide longitudinally and vertically adjust the foundation plate.

* * * * *